US011065499B2

(12) United States Patent
Chen

(10) Patent No.: US 11,065,499 B2
(45) Date of Patent: Jul. 20, 2021

(54) ADJUSTABLE DUMBBELL

(71) Applicant: FLORIEY INDUSTRIES INTERNATIONAL CO., Taichung (TW)

(72) Inventor: Paul Chen, Taichung (TW)

(73) Assignee: FLORIEY INDUSTRIES INTERNATIONAL CO., Taichung (TW)

( * ) Notice: Subject to any disclaimer, the term of this patent is extended or adjusted under 35 U.S.C. 154(b) by 44 days.

(21) Appl. No.: 16/693,541

(22) Filed: Nov. 25, 2019

(65) Prior Publication Data

US 2021/0154519 A1 May 27, 2021

(51) Int. Cl.

| | |
|---|---|
| ***A63B 21/075*** | (2006.01) |
| ***A63B 21/072*** | (2006.01) |
| ***A63B 21/005*** | (2006.01) |
| ***A63B 21/078*** | (2006.01) |

(52) U.S. Cl.

CPC ..... *A63B 21/075* (2013.01); *A63B 21/0058* (2013.01); *A63B 21/078* (2013.01); *A63B 21/0726* (2013.01); *A63B 21/0728* (2013.01)

(58) Field of Classification Search

CPC ..... A63B 21/00058; A63B 21/00061; A63B 21/00065; A63B 21/072; A63B 21/0722; A63B 21/0724; A63B 21/0726; A63B 21/0728; A63B 21/075; A63B 21/0004

See application file for complete search history.

(56) References Cited

U.S. PATENT DOCUMENTS

| | | | | |
|---|---|---|---|---|
| 5,407,413 | A | 4/1995 | Kupferman | |
| 5,839,997 | A | 11/1998 | Roth et al. | |
| 6,656,093 | B2 | 12/2003 | Chen | |
| 7,223,214 | B2 | 5/2007 | Chen | |
| 7,731,641 | B1 | 6/2010 | Chen | |
| 7,811,213 | B2 | 10/2010 | Chen | |
| 9,616,273 | B2 | 4/2017 | Chen | |
| 10,022,583 | B2 * | 7/2018 | Wang | A63B 71/0036 |
| 10,343,010 | B2 | 7/2019 | Chen | |
| 10,463,906 | B2 * | 11/2019 | Owusu | A63B 21/4035 |
| 2003/0148862 | A1 * | 8/2003 | Chen | A63B 21/063 482/108 |
| 2009/0197745 | A1 * | 8/2009 | Olson | A63B 21/0728 482/107 |
| 2009/0305852 | A1 * | 12/2009 | Hoglund | A63B 21/0728 482/107 |
| 2018/0078811 | A1 * | 3/2018 | Chen | A63B 21/0726 |

* cited by examiner

*Primary Examiner* — Megan Anderson
*Assistant Examiner* — Kathleen Vermillera
(74) *Attorney, Agent, or Firm* — Browdy and Neimark, PLLC

(57) ABSTRACT

An adjustable dumbbell assembly includes a dumbbell mechanism having two or more weight members engaged in a receptacle, and a handle bar engaged between the weight members, two catches slidably engaged in the handle bar and extendible out and engageable with the weight members for detachably attaching the weight members to the handle bar, two followers slidably engaged in the receptacle and each having a protrusion for engaging with the catches and for moving the catches to engage with the weight members, and for detachably attaching the weight members to the handle bar, and an actuating member engaged with the followers for actuating the followers to move the catches to engage with the weight members.

20 Claims, 11 Drawing Sheets

ADJUSTABLE DUMBBELL

BACKGROUND OF THE INVENTION

1. Field of the Invention

The present invention relates to an adjustable dumbbell, and more particularly to an adjustable dumbbell assembly having an easily and quickly adjustable structure for easily and quickly adjusting the weight of two adjustable dumbbell devices or mechanisms of the dumbbell assembly.

2. Description of the Prior Art

Various kinds of typical adjustable dumbbells have been developed and provided for conducting various exercise operations, for example, U.S. Pat. No. 5,407,413 to Kupferman, U.S. Pat. No. 5,839,997 to Roth et al., U.S. Pat. No. 6,656,093 to Chen, U.S. Pat. No. 7,223,214 to Chen, U.S. Pat. No. 7,731,641 to Chen, U.S. Pat. No. 7,811,213 to Chen, U.S. Pat. No. 9,616,273 to Chen, and U.S. Pat. No. 10,343,010 to Chen disclose several of the typical adjustable dumbbells each including a number of weight members or weight rings that may be selectively or adjustably secured together for adjusting the weight of the dumbbells.

Normally, in the typical adjustable dumbbells, two extension carriers or tracks are formed or provided on the end portions or extended outwardly from the end portions of the central handle bar, and the weight rings may be selectively or adjustably secured to the extension carriers or tracks.

However, the extension carriers or tracks are required to be permanently formed or provided on the end portions of the central handle bar such that the extension carriers or tracks and the central handle bar may form and may include a greatly increased length for the typical adjustable dumbbells.

In addition, the extension carriers or tracks are each required to be moved and adjusted relative to the central handle bar respectively for adjusting the weight of the dumbbells, but may not be moved and adjusted relative to the central handle bar simultaneously.

The present invention has arisen to mitigate and/or obviate the afore-described disadvantages of the conventional adjustable dumbbells.

SUMMARY OF THE INVENTION

The primary objective of the present invention is to provide an adjustable dumbbell assembly including an easily and quickly adjustable structure for easily and quickly adjusting the weight of two adjustable dumbbell devices or mechanisms of the dumbbell assembly.

In accordance with one aspect of the invention, there is provided an adjustable dumbbell assembly comprising a receptacle including a first compartment and a second compartment, a first dumbbell mechanism including a first weight member engaged in the first compartment of the receptacle, a second weight member engaged in the second compartment of the receptacle, and a handle bar engaged between the first weight member and the second weight member, the handle bar including a bore formed in the handle bar, a first catch and a second catch slidably received and engaged in the bore of the handle bar and extendible out of the handle bar and engageable with the first weight member and the second weight member, for detachably attaching the first weight member and the second weight member to the handle bar, a first follower and a second follower slidably received and engaged in the receptacle, and the first follower and the second follower each include a protrusion for engaging with the first catch and the second catch and for moving the first catch and the second catch to engage with the first weight member and the second weight member, and for detachably attaching the first weight member and the second weight member to the handle bar, and an actuating member engaged with the receptacle and engaged with the first and the second followers for easily and quickly actuating the first and the second followers to move relative to the receptacle and for actuating the first and the second followers to move the first catch and the second catch to engage with the first weight member and the second weight member.

The first and the second followers each include a rack, and the actuating member includes a wheel engaged with the racks of the first and the second followers for moving the first and the second followers relative to each other when the actuating member is rotated relative to the receptacle. The actuating member may further include a motor driving member coupled to the wheel for driving the wheel to move the followers relative to the receptacle with the motor driving member selectively.

The first follower and the second follower each include a protrusion for engaging with the first catch and the second catch and for moving the first catch and the second catch to engage with the first weight member and the second weight member, and for detachably attaching the first weight member and the second weight member to the handle bar.

The receptacle includes two grooves formed in the receptacle for slidably receiving and engaging with the protrusions of the first follower and the second follower respectively and for guiding the first follower and the second follower to slide relative to the receptacle. The receptacle includes a plurality of notches formed in the receptacle, and the protrusions each include a tongue for engaging with the notches of the receptacle.

The handle bar includes two housings provided at end portions, the bore of the handle bar is formed through the housings. The first and the second weight members each include two projections, and the housings each include two dovetail slots formed in the housings respectively for receiving and engaging with the projections of the first and the second weight members and for anchoring the first and the second weight members to the housings of the handle bar respectively.

The housings each include a key hole formed in the respective housing, and the first and the second weight members each include a key hole aligned with the key holes of the housings. The first and the second catches each include an extension slidably engageable into and through the key holes of the housings and of the first and the second weight members. The first and the second weight members each include a seat provided in a lower portion of the key hole of the first and the second weight members, the housings each include a seat provided in a lower portion of the key hole of the housing.

The first follower and the second follower each include a protrusion for engaging with the first catch and the second catch, and the first and the second catches each include a spring biased sliding member engageable with the seat of the first and the second weight members and the housings, the spring biased sliding member is engageable with the protrusion of the first and the second followers selectively. The first and the second weight members each include two dovetail slots formed in the first and the second weight members respectively.

A second dumbbell mechanism is further provided and includes a first weight element and a second weight element engaged in the receptacle, and a second handle bar engaged between the first and the second weight elements, the second handle bar including a bore formed in the second handle bar, a first latch and a second latch slidably received and engaged in the bore of the second handle bar and extendible out of the second handle bar and engageable with the first weight element and the second weight element, for detachably attaching the first and the second weight elements to the second handle bar.

The second handle bar includes two second housings provided at end portions, the bore of the second handle bar is formed through the second housings. The first and the second weight elements each include two projections, and the second housings each include two dovetail slots formed in the second housings respectively for receiving and engaging with the projections of the first and the second weight elements and for anchoring the first and the second weight elements to the second housings of the second handle bar respectively.

The second housings each include a key hole formed in the respective second housing, and the first and the second weight elements each include a key hole formed therein and aligned with the key holes of the second housings. The first and the second latches each include an extension slidably engageable into and through the key holes of the second housings and of the first and the second weight elements.

The first and the second weight elements each include a seat provided in a lower portion of the key hole of the first and the second weight elements, the second housings each include a seat provided in a lower portion of the key hole of the second housing. The first and the second followers each include a second protrusion for engaging with the first and the second latches and for moving the first and the second latches to engage with the first and the second weight elements, and for detachably attaching the first and the second weight elements to the second handle bar, the first and the second latches each include a spring biased sliding member engageable with the seat of the first and the second weight elements and the second housings, the spring biased sliding member is engageable with the second protrusion of the first and the second followers selectively.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
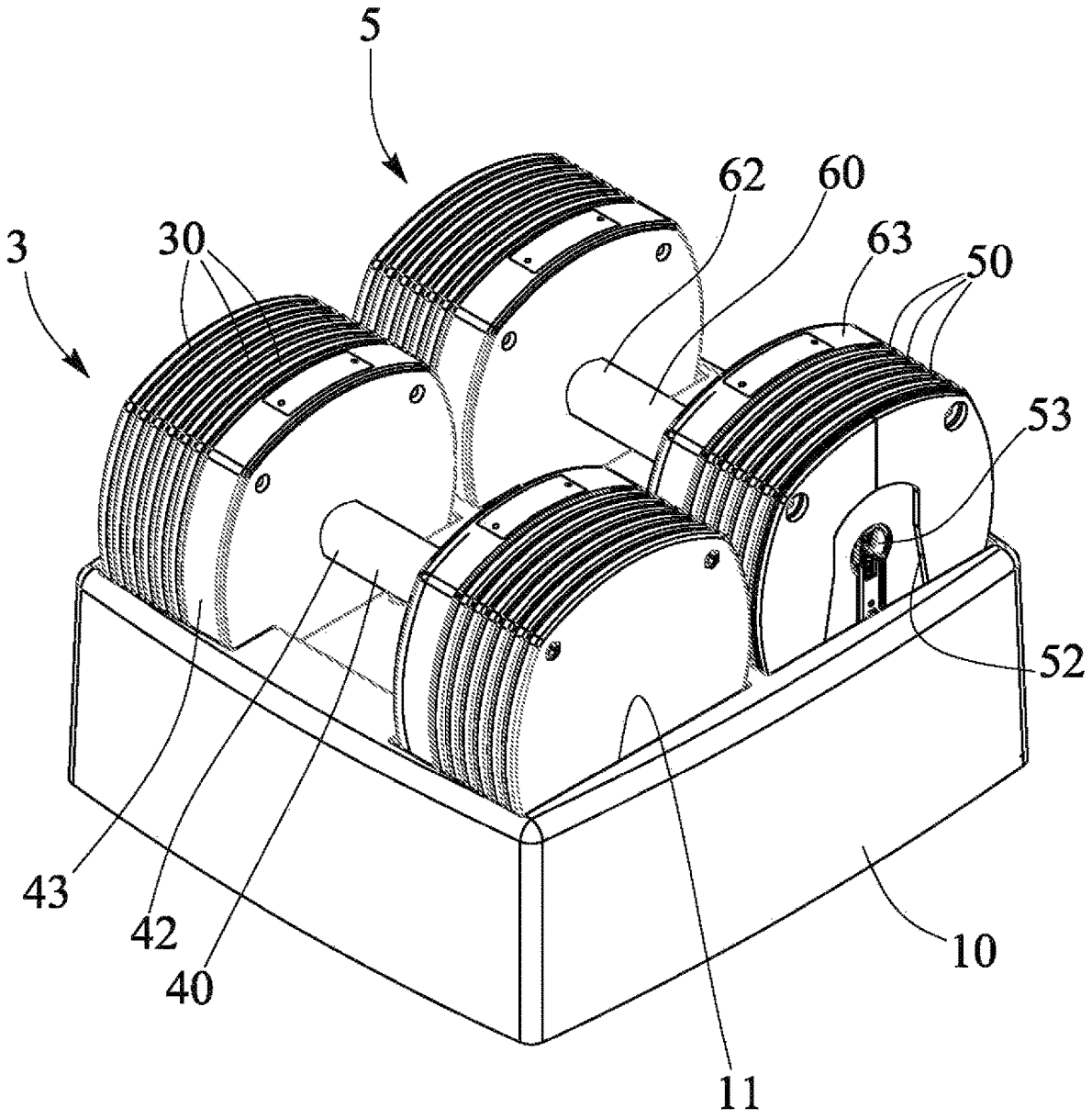
FIG. 1 is a perspective view of an adjustable dumbbell assembly in accordance with the present invention.
Figure 2:
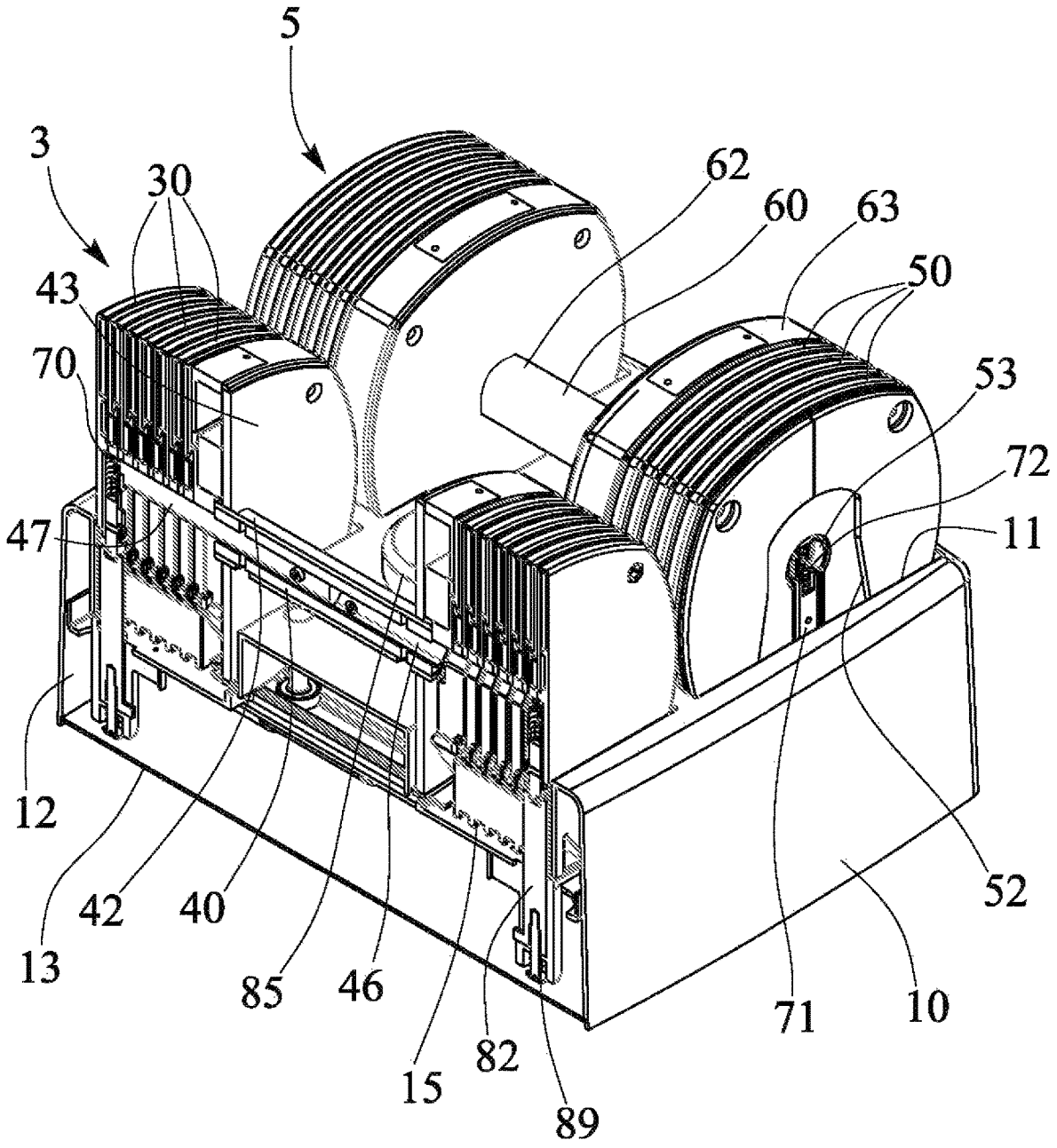
FIGS. 2, 3 are further perspective views of the adjustable dumbbell assembly similar to FIG. 1, in which a portion of the adjustable dumbbell assembly has been cut off for showing the inner structure of the adjustable dumbbell assembly.
Figure 3:
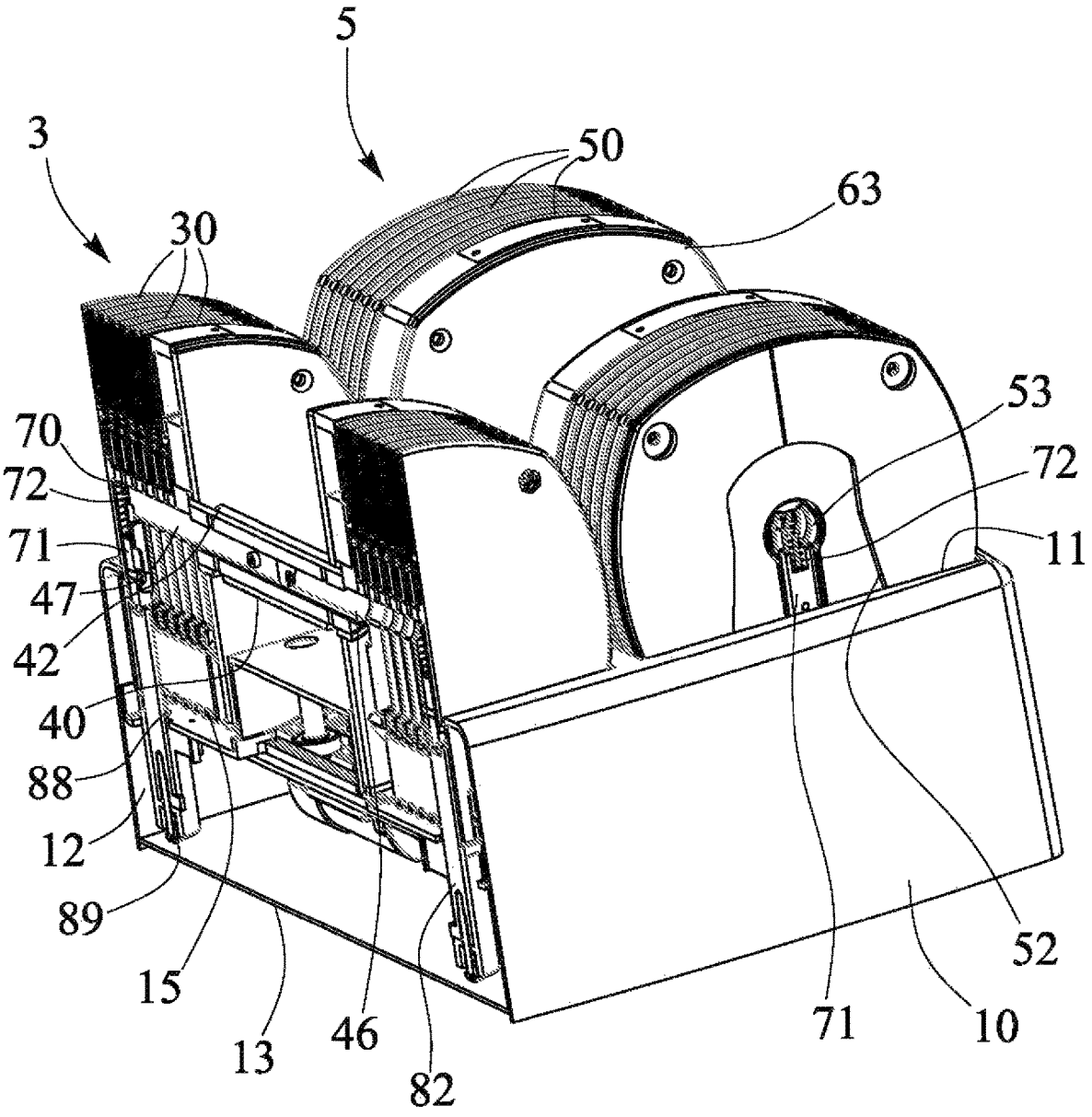
Figure 4:
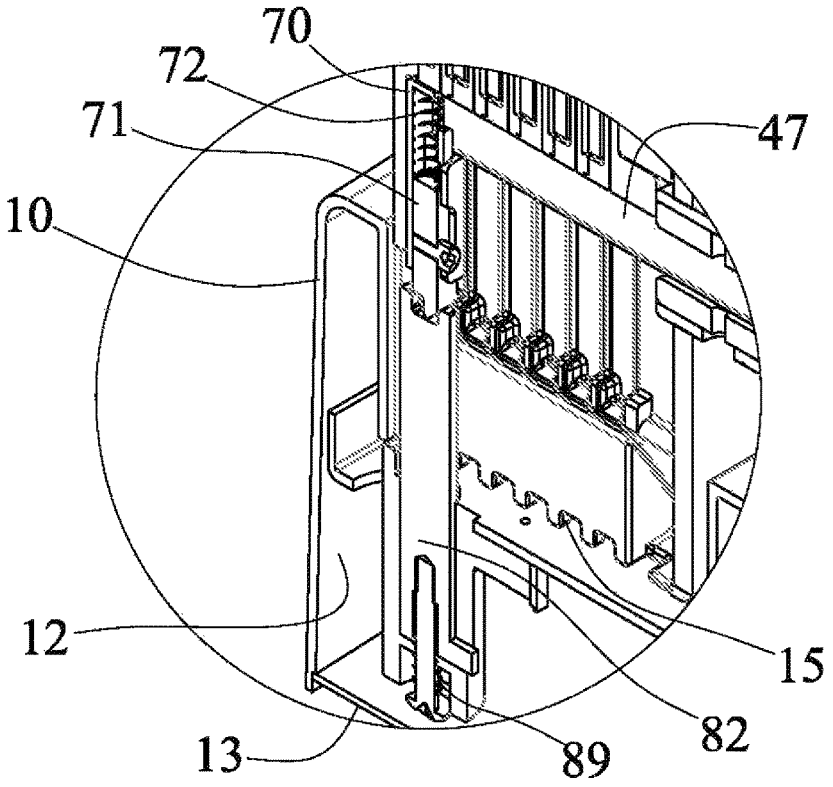
FIGS. 4, 5 are enlarged partial perspective views of the adjustable dumbbell assembly.
Figure 5:
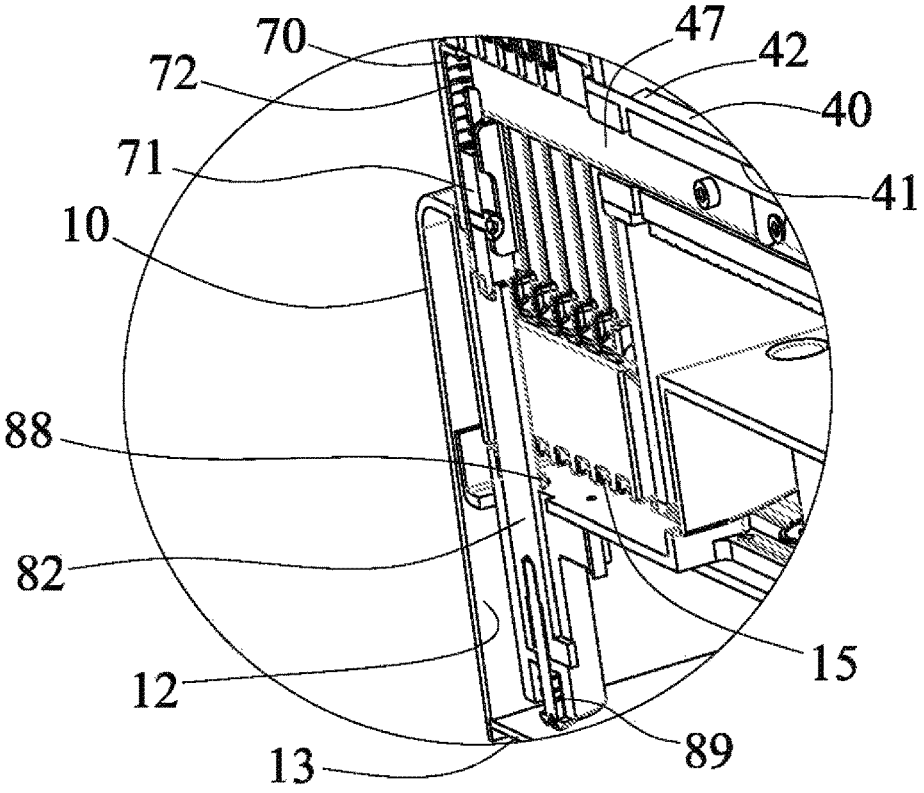
Figure 6:
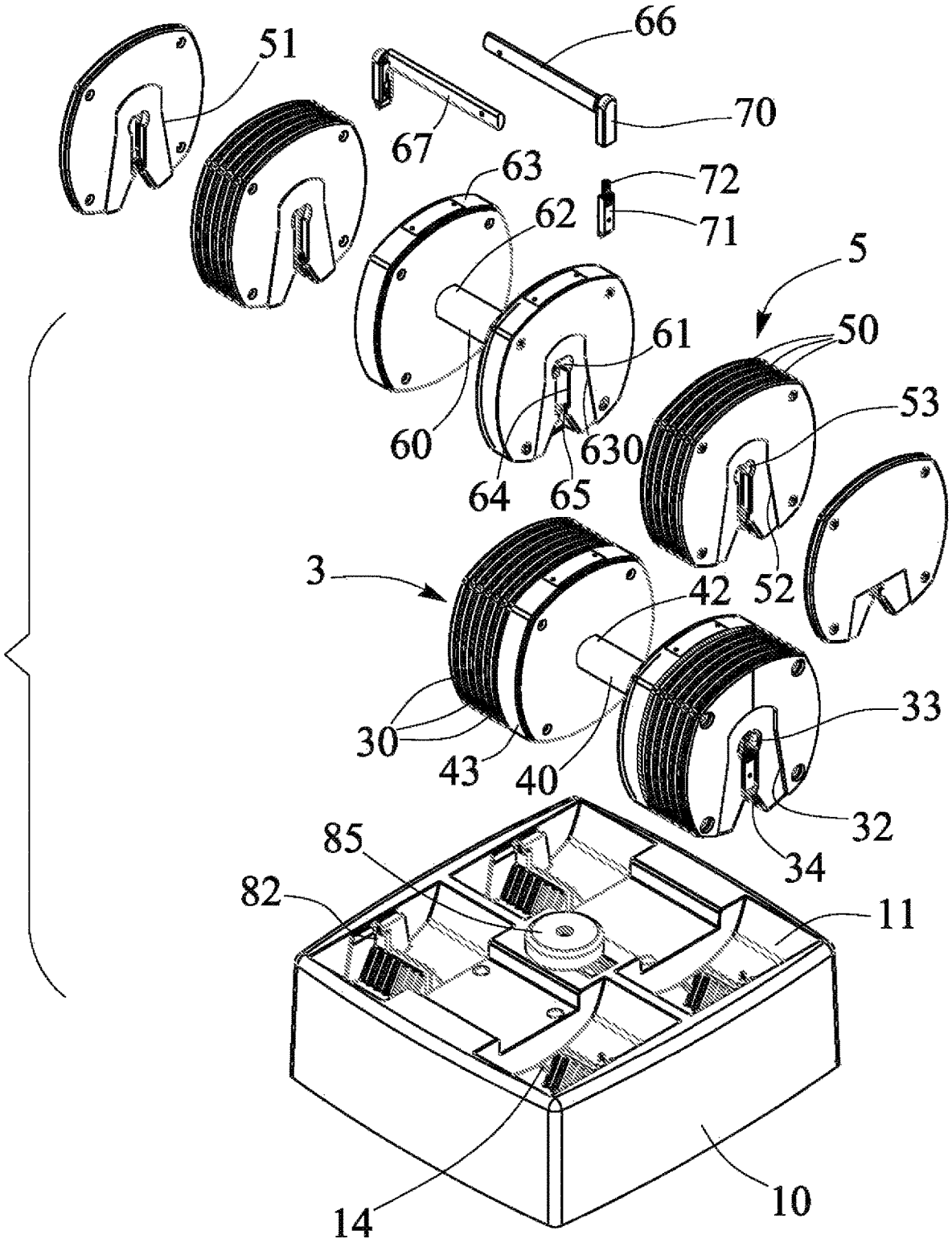
FIG. 6 is a partial exploded view of the adjustable dumbbell assembly.

Referring to the drawings, and initially to FIGS. 1-5, an adjustable dumbbell assembly in accordance with the present invention comprises a supporting base or receptacle 10 including one or more (such as four) depressions or recesses or compartments 11 formed therein for selectively receiving or engaging with the weights 30, 50, such as weight rings or plates or members 30 and weight elements 50 of the first and the second adjustable dumbbell devices or mechanisms 3, 5 respectively, and including a space or compartment or chamber 12 formed therein (FIGS. 2-5, 8, and 11-12), such as formed in the lower or bottom portion thereof, and a cap or cover 13 attached or mounted or secured to the lower or bottom portion of the receptacle 10 for covering or enclosing the chamber 12 of the receptacle 10, and including one or more (such as four) slots or grooves 14 formed therein (FIGS. 6-8, 10) and communicating with the chamber 12 and the compartments 11 of the receptacle 10 respectively.

The adjustable dumbbell mechanisms 3, 5 each include two or a first and a second groups of weight members 30 or weight elements 50 to be seated or engaged or received in the first and the second compartments 11 of the receptacle 10 respectively, best shown in FIGS. 1-3, 6, and 9-12. The weight members 30 and the weight elements 50 each include a projection or catch or dovetail 31, 51 formed or provided on the inner side portion thereof (FIGS. 6 and 9), and a slot 32, 52, such as dovetail slot 32, 52 formed therein (FIGS. 1-3, 6, and 9-10), such as formed in the outer side portion thereof for receiving or engaging with the projection 31, 51 of the other weight members 30 or weight elements 50 and for anchoring or retaining or positioning the weight members 30 and the weight elements 50 together, and arranged for allowing the weight members 30 and the weight elements 50 to be moved up and down relative to each other, but arranged for preventing the weight members 30 and the weight elements 50 from being moved sidewise relative to each other and for preventing the weight members 30 and the weight elements 50 from being disengaged or separated from each other.

The weight members 30 and the weight elements 50 each further include a hole 33, 53, such as a key hole 33, 53 formed therein, and the key holes 33, 53 of the weight members 30 and the weight elements 50 are aligned with each other, and each further include a socket or seat 34, 54 formed or provided in the lower or bottom portion of each of the key holes 33, 53 of the respective weight member 30 or weight element 50. The dumbbell mechanisms 3, 5 each further include a central handle bar 40, 60 to be disposed or engaged between two groups or the first and the second weight members 30 and two groups or the first and the second weight elements 50 respectively, the handle bars 40, 60 each include an elongated or longitudinal hole or bore 41, 61 formed therein (FIGS. 5, 6, 9, and 11-12), and each include one or more (such as two) end portions 42, 62 each having a plate or housing 43, 63 extended radially and outwardly therefrom, the bores 41, 61 of the handle bars 40, 60 are also formed through the housings 43, 63 respectively.

The housings 43, 63 each include a hole 44, 64, such as a key hole 44, 64 formed therein (FIGS. 6 and 9), such as formed in the outer side portion thereof and communicating with the bore 41, 61 of the respective handle bar 40, 60, for aligning with the key holes 33, 53 of the weight members 30 and the weight elements 50, and each further include a socket or seat 45, 65 formed or provided in the lower or bottom portion of each of the key holes 44, 64 of the respective housings 43, 63. The key holes 44, 64 of the housings 43, 63 are also aligned with the key holes 33, 53 of the weight members 30 and the weight elements 50 when the handle bars 40, 60 are disposed or engaged between the weight members 30 and the weight elements 50 respectively. The housings 43, 63 each further include one or more (such as two) slots 430, 630, such as dovetail slots 430, 630 formed therein (FIGS. 6, 9), such as formed in the outer side portion thereof for receiving or engaging with the projections 31, 51 at the inner side portion of the weight members 30 and the weight elements 50 and for anchoring or retaining or positioning the weight members 30 and the weight elements 50 to the housings 43, 63 of the handle bars 40, 60 respectively and selectively.

The dumbbell mechanisms 3, 5 each further include one or more (such as two) rods or catches 46, 47 and latches 66, 67 (FIGS. 2-6 and 11-12) slidably received or engaged in the bore 41, 61 of the handle bar 40, 60 and extendible out of the housing 43, 63 and the end portions 42, 62 of the handle bar 40, 60, and engageable into the key holes 44, 64 of the housings 43, 63 and the key holes 33, 53 of the weight members 30 and the weight elements 50, for detachably or changeably or removably and/or adjustably attaching or mounting or securing the required or predetermined number of the two groups or the first and the second weight members 30 and the two groups or the first and the second weight elements 50 to the housing 43, 63 or the end portions 42, 62 of the handle bar 40, 60 respectively. As shown in FIGS. 2-6 and 11-12, the catches 46, 47 and the latches 66, 67 each include an extension 70 extended downwardly from one end portion thereof and slidably engageable into and through the key holes 44, 64 of the housings 43, 63 and the key holes 33, 53 of the weight members 30 and the weight elements 50.

The catches 46, 47 and the latches 66, 67 each further include a follower or sliding member 71 slidably attached or mounted or secured to the extension 70 and anchored or retained to the extension 70 and arranged to be prevented from being disengaged or separated from the extension 70, and a spring biasing member 72 engaged between the catches 46, 47 and the latches 66, 67 and/or the extension 70 and the spring biased sliding member 71 for biasing and forcing or moving the sliding member 71 downwardly relative to the catches 46, 47 and the latches 66, 67 and/or the extension 70, and for biasing and forcing or moving the sliding member 71 to engage with the seat 45, 65 of the handle bar 40, 60 and the seat 34, 54 of the weight members 30 and the weight elements 50 (FIGS. 2-5, 9-12) and for selectively anchoring or retaining or positioning the catches 46, 47 and the latches 66, 67 to the housings 43, 63 and the weight members 30 and the weight elements 50 respectively.

Figure 11:
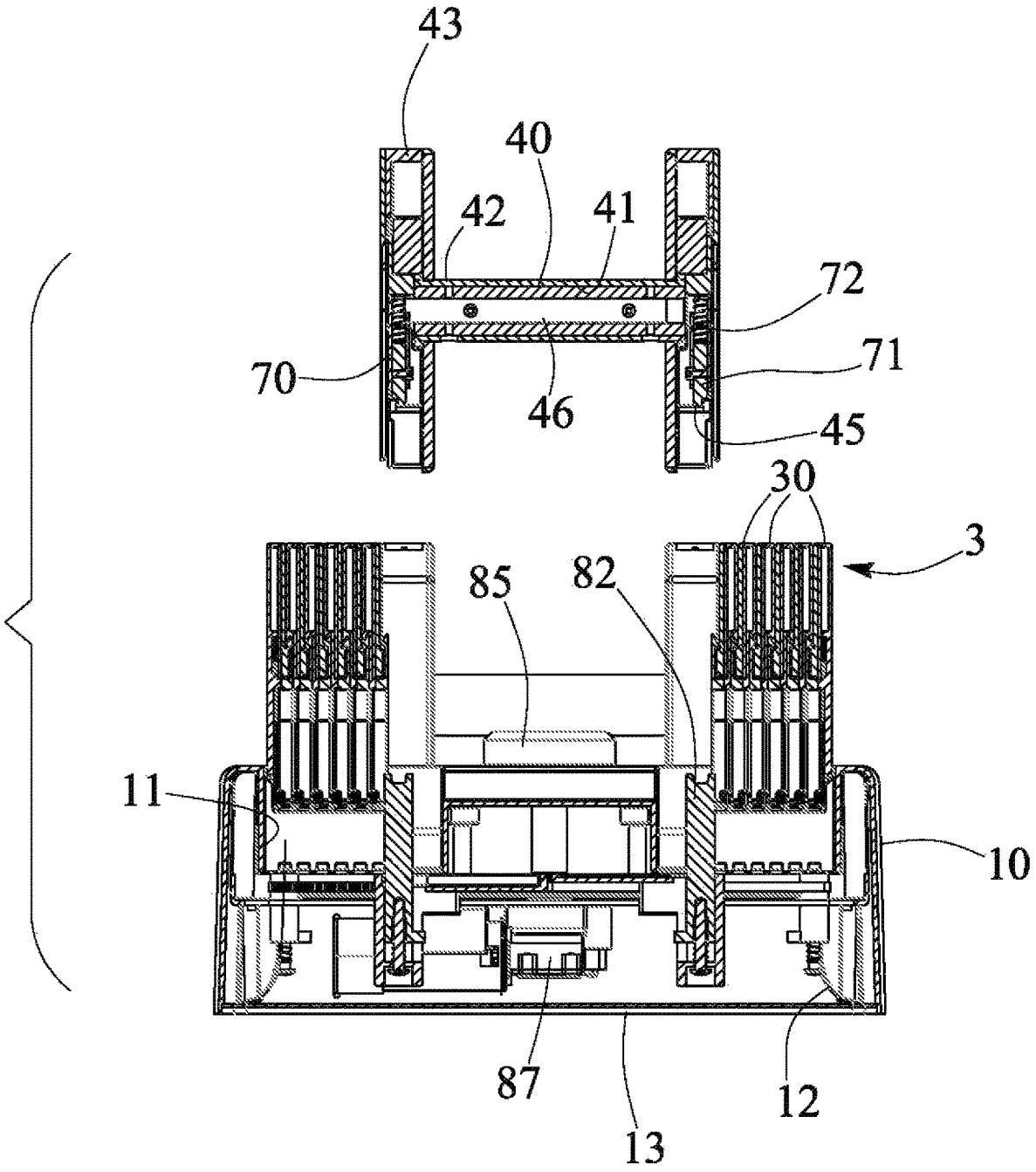
FIG. 11 is a partial exploded and cross sectional view of the adjustable dumbbell assembly, taken along lines 11-11 of FIG. 9.
Figure 12:
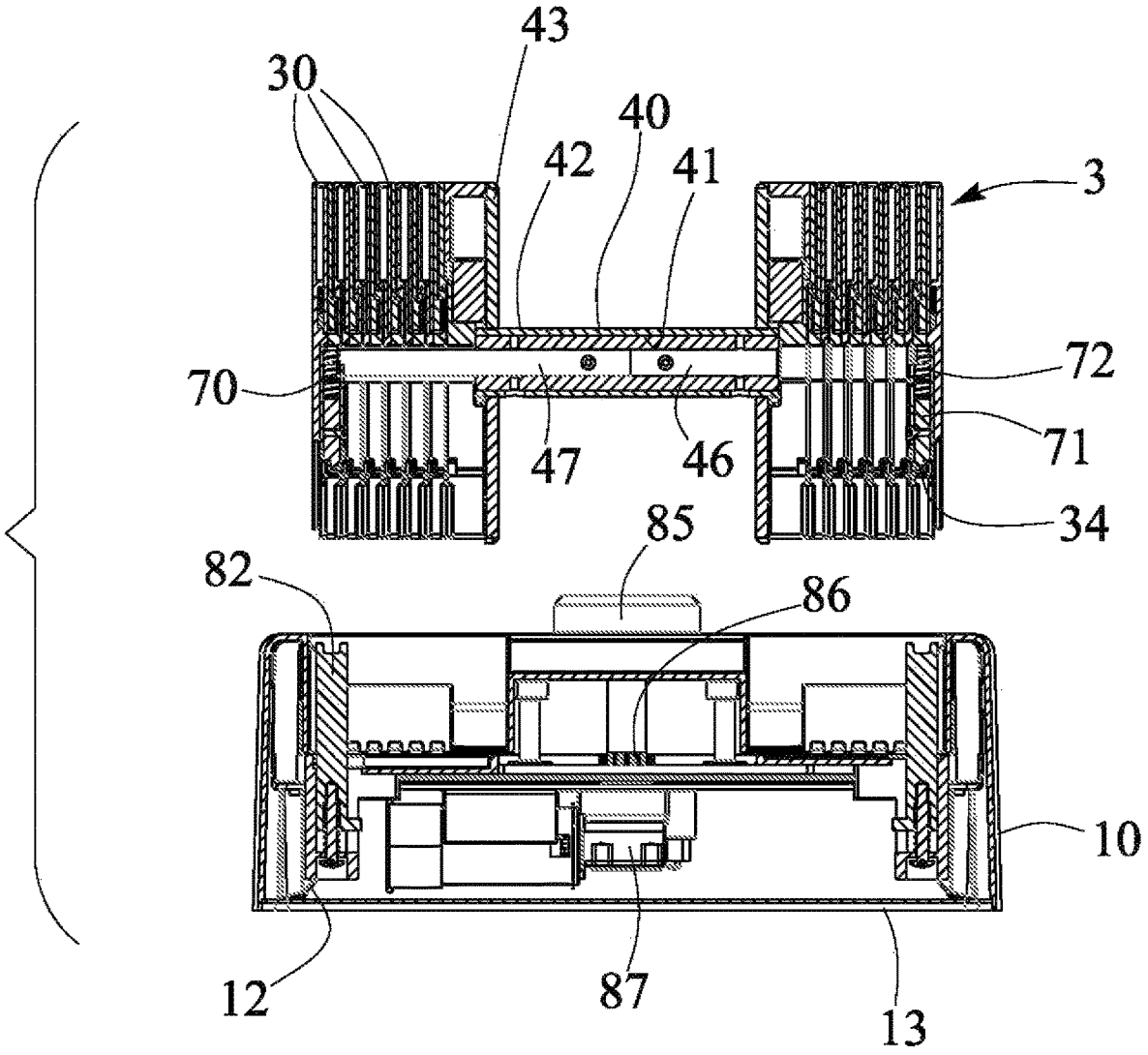
FIG. 12 is another partial exploded and cross sectional view of the adjustable dumbbell assembly, taken along lines 12-12 of FIG. 10.

In operation, as shown in FIG. 11, when the handle bar 40, 60 is disengaged or separated from the weight members 30 and/or the weight elements 50, the spring biasing member 72 may bias and force and move the sliding member 71 to engage with the seat 45, 65 of the handle bar 40, 60, for anchoring or retaining or positioning the catch 46, 47 and/or the latch 66, 67 to the handle bar 40, 60 and for preventing the catch 46, 47 and/or the latch 66, 67 from being disengaged or separated from the handle bar 40, 60. As shown in FIG. 12, when the handle bar 40, 60 and the required or predetermined number of the weight members 30 and/or the weight elements 50 are moved or disengaged or separated from the receptacle 10, the spring biasing member 72 may bias and force and move the sliding member 71 to engage with the seat 34, 54 of the weight members 30 and the weight elements 50 for anchoring or retaining or positioning the catch 46, 47 and/or the latch 66, 67 to the weight members 30 and the weight elements 50 and for preventing the catch 46, 47 and/or the latch 66, 67 from being disengaged or separated from the weight members 30 and the weight elements 50.

As shown in FIGS. 7-8 and 11-12, the receptacle 10 further includes two or a first and a second racks or sliding members or followers 80, 81 slidably received or engaged in the chamber 12 of the receptacle 10 and movable relative to each other, and the first and the second followers 80, 81 each include one or more (such as two) carriers or seats or protrusions 82 extended upwardly therefrom and slidably engaged into and through the grooves 14 of the receptacle 10 respectively (FIGS. 6, 9-10) for guiding and limiting the followers 80, 81 to slide or move relative to the receptacle 10. The protrusions 82 of the followers 80, 81 are provided for engaging with the sliding members 71 of the catches 46, 47 and the latches 66, 67 (FIGS. 2-5) and for disengaging or separating the sliding members 71 of the catches 46, 47 and the latches 66, 67 from the seat 45, 65 of the handle bar 40, 60 and the seat 34, 54 of the weight members 30 and the weight elements 50, and thus for allowing the catches 46, 47 and the latches 66, 67 to be moved through the key holes 44, 64 of the housings 43, 63 and the key holes 33, 53 of the weight members 30 and the weight elements 50, and thus for allowing the catches 46, 47 and the latches 66, 67 to be moved to engage with the required or predetermined number of the weight members 30 and/or the weight elements 50.

Figure 10:
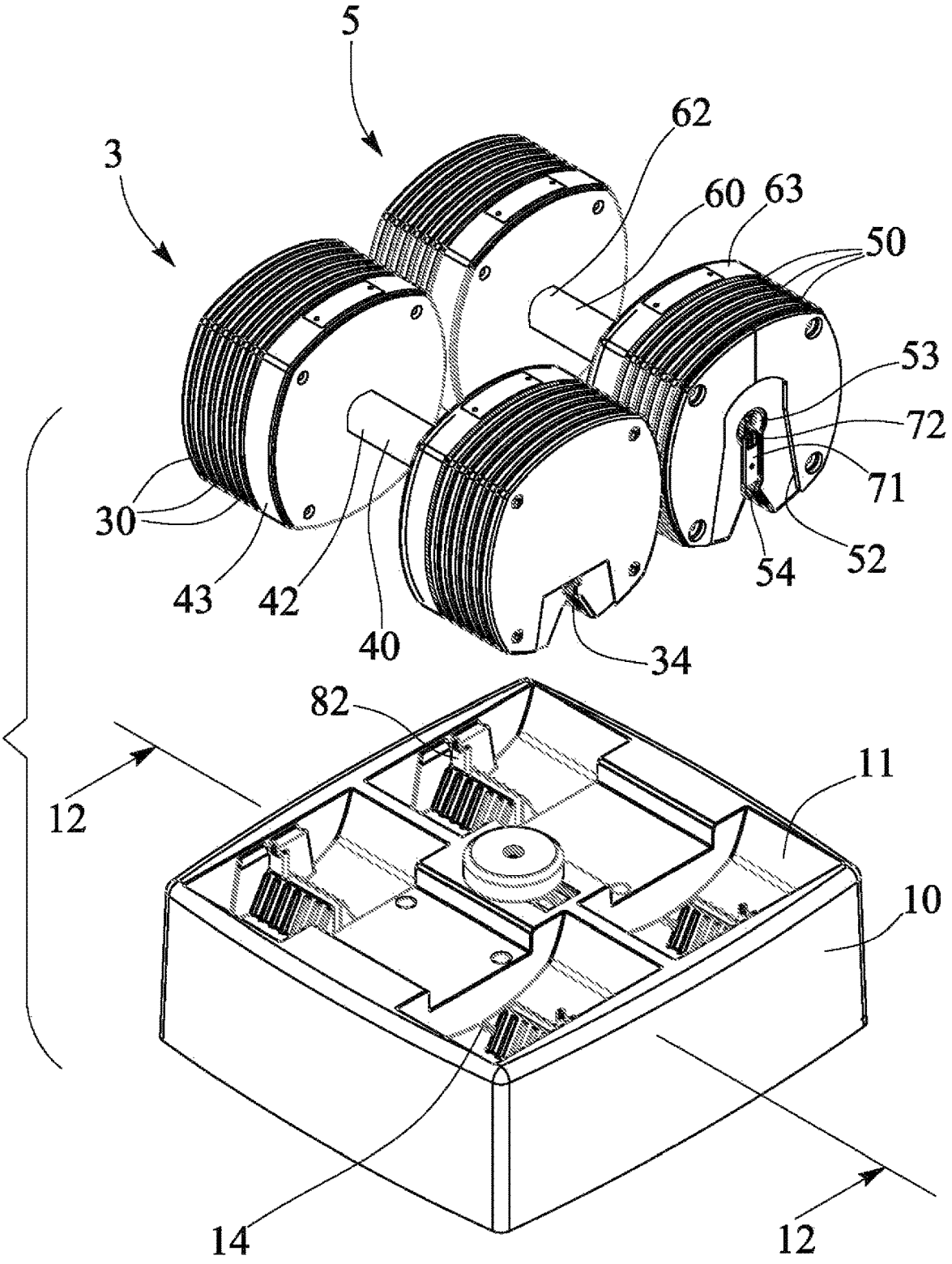

As shown in FIGS. 10 and 12, when the handle bar 40, 60 and the required or predetermined number of the weight members 30 and/or the weight elements 50 are moved or disengaged or separated from the receptacle 10, the spring biasing member 72 may bias and force and move the sliding member 71 to engage with the seat 45, 65 of the handle bar 40, 60 and/or the seat 34, 54 of the weight members 30 and the weight elements 50 for anchoring or retaining or positioning the catch 46, 47 and/or the latch 66, 67 to the weight members 30 and the weight elements 50 and for preventing the catch 46, 47 and/or the latch 66, 67 from being disengaged or separated from the weight members 30 and the weight elements 50, and also for preventing the weight members 30 and the weight elements 50 from being disengaged or separated from the handle bar 40, 60.

Figure 7:
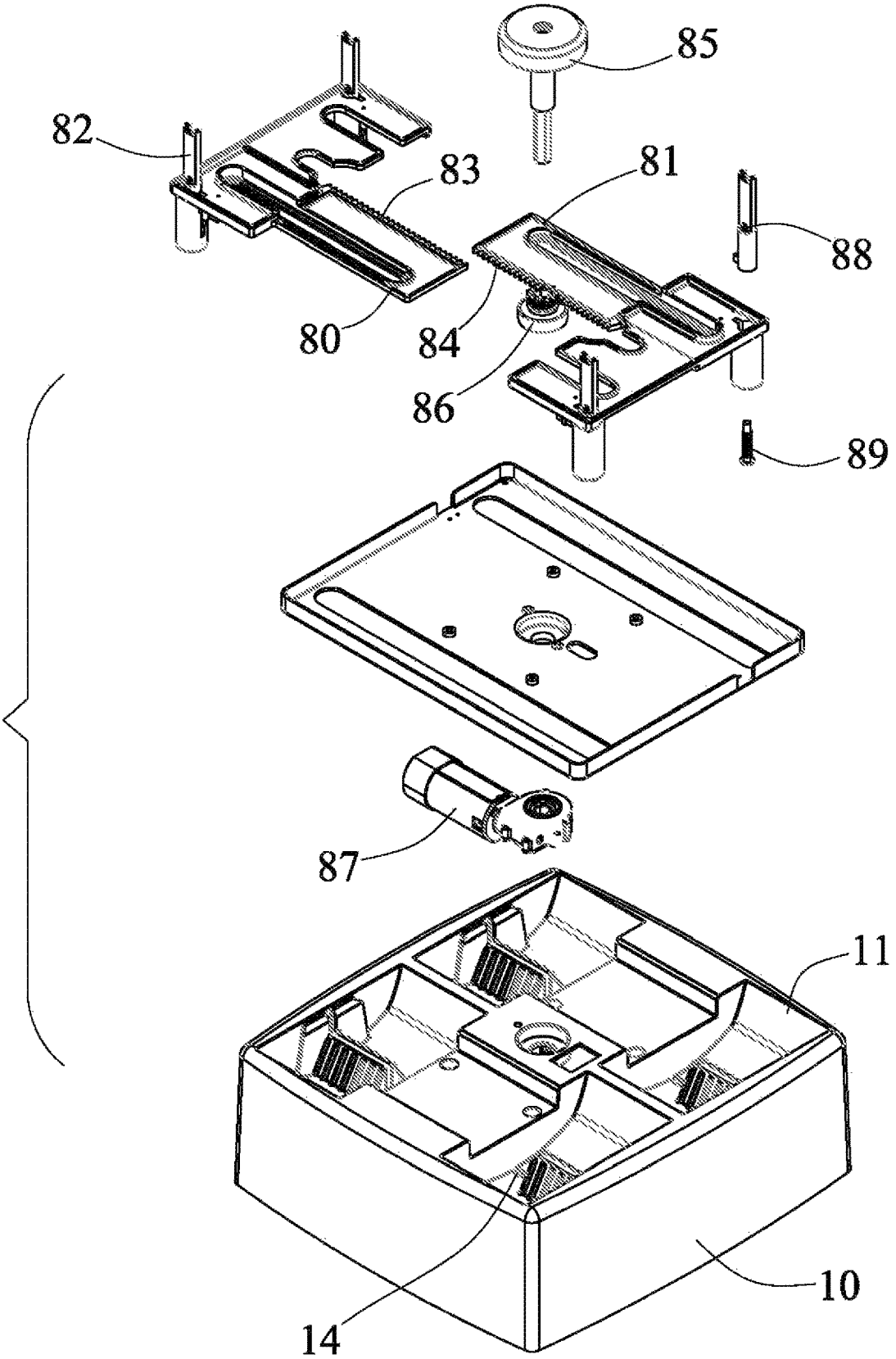
FIG. 7 is another partial exploded view as seen from the upper portion of the adjustable dumbbell assembly.
Figure 8:
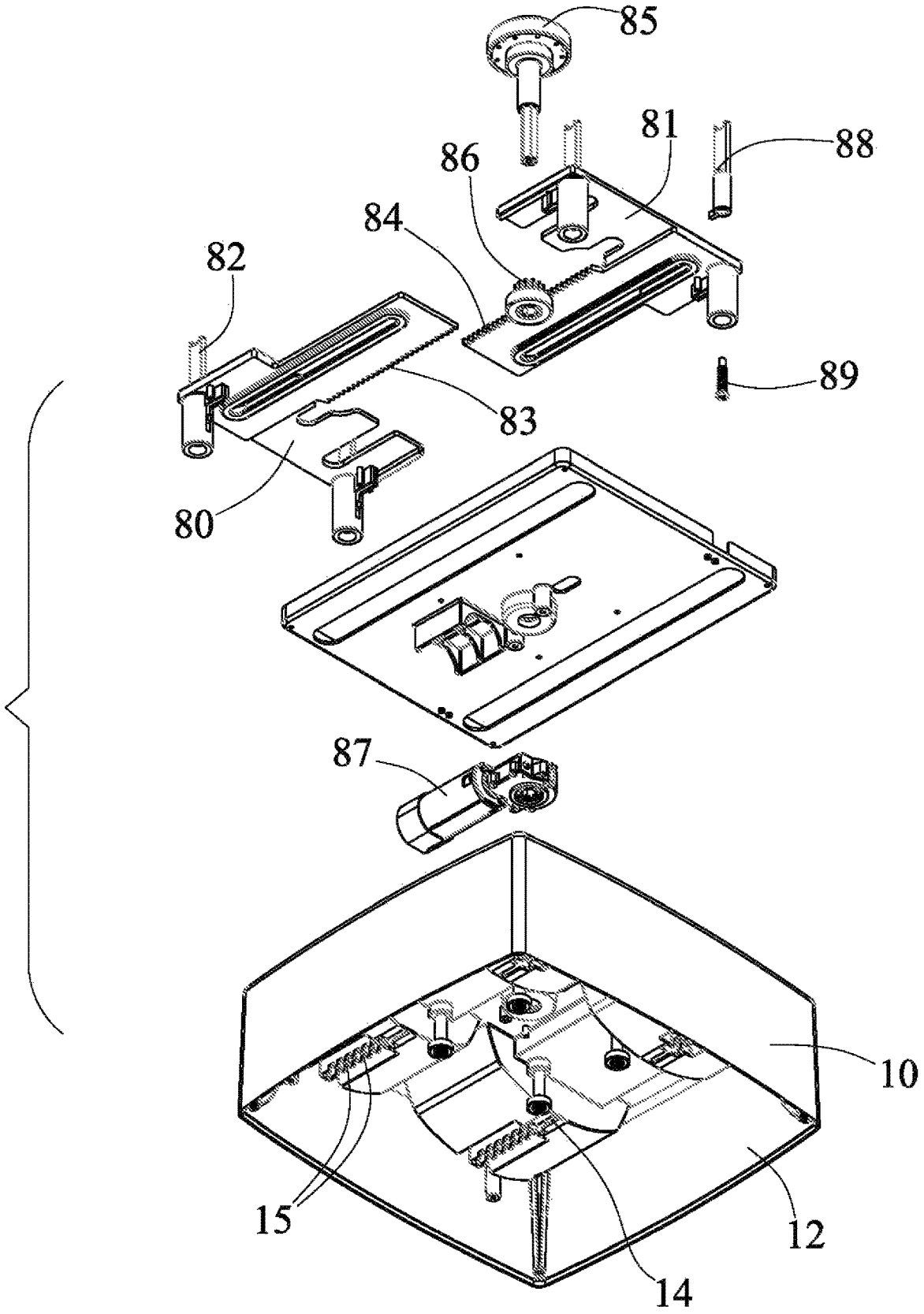
FIG. 8 is a further partial exploded view as seen from the lower portion of the adjustable dumbbell assembly.
Figure 9:
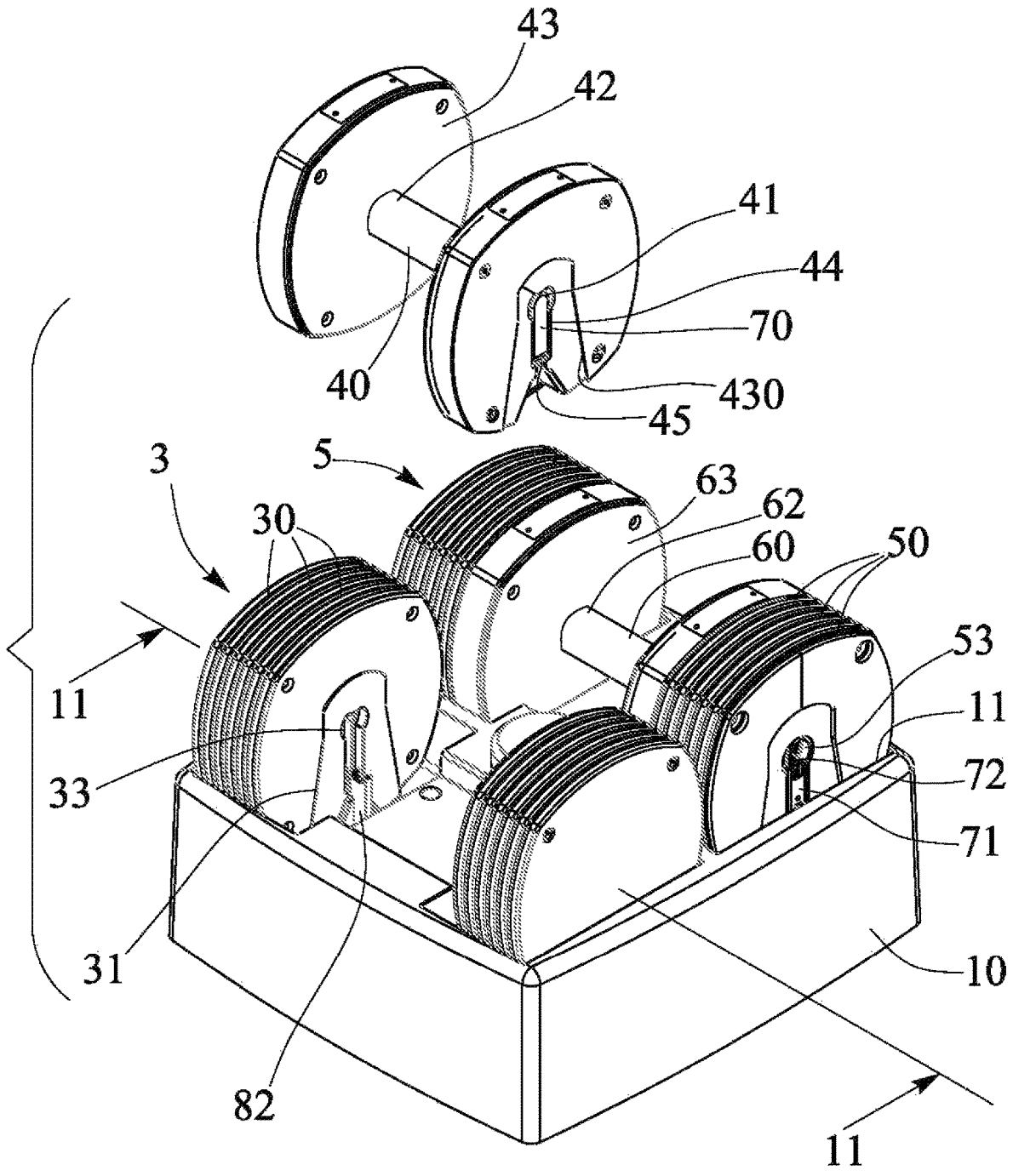
FIGS. 9 and 10 are still further partial exploded views similar to FIG. 6, illustrating the operation of the adjustable dumbbell assembly.

As shown in FIGS. 7 and 8, the followers 80, 81 each include a track or rack 83, 84 formed or provided thereon, and a knob or rotating or actuating member 85 is pivotally or rotatably attached or mounted to or engaged with the receptacle 10, and the actuating member 85 includes a gear or wheel 86 engaged with the racks 83, 84 of the followers 80, 81 for actuating or operating and moving the followers 80, 81 relative to each other when the actuating member 85 is pivoted or rotated relative to the receptacle 10, and thus for moving the catches 46, 47 and the latches 66, 67 to engage with the required or predetermined number of the weight members 30 and/or the weight elements 50 with the protrusions 82 of the followers 80, 81. A motor driving member 87 may further be provided and coupled to the wheel 86 for driving the wheel 86 to move the followers 80, 81 relative to each other.

The receptacle 10 further includes a number of cavities or notches 15 (FIGS. 2-5 and 8) formed or provided therein and arranged beside the grooves 14 of the receptacle 10, and the protrusions 82 of the followers 80, 81 each include a detent or tongue 88 extended therefrom (FIGS. 3, 8) for selectively engaging with the notches 15 of the receptacle 10 and for anchoring or retaining or positioning the protrusions 82 and the followers 80, 81 to the receptacle 10 at the required or predetermined or selected position, and a spring biasing member 89 is engaged with the protrusion 82 for biasing the tongue 88 of the protrusion 82 to engage with the notches 15 of the receptacle 10.

As shown in FIGS. 2-3 and 5-6, when the housings 43, 63 of the handle bars 40, 60 and/or the weight members 30 and the weight elements 50 are disposed or engaged into the compartments 11 of the receptacle 10 respectively, the housing 43, 63 may be contacted or engaged with the protrusions 82 for disengaging or separating the tongues 88 of the protrusions 82 from the notches 15 of the receptacle 10, and for allowing the followers 80, 81 to be slid or moved relative to the receptacle 10. In operation, as shown in FIGS. 1-3, 9 and 11, the weight members 30 and the weight elements 50 may be disposed or engaged into the compartments 11 of the receptacle 10 respectively, and the handle bars 40, 60 may be disposed or engaged between the weight members 30 and the weight elements 50 respectively. At this moment, the housing 43, 63 may be engaged with the protrusions 82 for disengaging the tongues 88 from the notches 15 of the receptacle 10, and for allowing the followers 80, 81 to be slid or moved relative to the receptacle 10.

As shown in FIGS. 2-3 and 5-6, when the housings 43, 63 of the handle bars 40, 60 are disposed or engaged onto the receptacle 10, the protrusions 82 of the followers 80, 81 may be engaged with the sliding members 71 of the catches 46, 47 and the latches 66, 67 for disengaging or separating the sliding members 71 of the catches 46, 47 and the latches 66, 67 from the seat 45, 65 of the handle bar 40, 60 and the seat 34, 54 of the weight members 30 and the weight elements 50, and thus for allowing the catches 46, 47 and the latches 66, 67 to be moved through the key holes 44, 64 of the housings 43, 63 and the key holes 33, 53 of the weight members 30 and the weight elements 50, and thus for allowing the catches 46, 47 and the latches 66, 67 to be moved to engage with the required or predetermined number of the weight members 30 and/or the weight elements 50.

As shown in FIGS. 9-12, when the housings 43, 63 of the handle bars 40, 60 and/or the weight members 30 and the weight elements 50 are moved or disengaged or separated from the receptacle 10, the spring biasing member 72 may bias and force and move the sliding member 71 to engage with the seat 45, 65 of the handle bar 40, 60 and/or the seat 34, 54 of the weight members 30 and the weight elements 50 for anchoring or retaining or positioning the catch 46, 47 and/or the latch 66, 67 to the weight members 30 and the weight elements 50 and for preventing the catch 46, 47 and/or the latch 66, 67 from being disengaged or separated from the weight members 30 and the weight elements 50, and also for preventing the weight members 30 and the weight elements 50 from being disengaged or separated from the handle bar 40, 60. The catch 46, 47 and/or the latch 66, 67 of the handle bars 40, 60 may thus be easily and quickly and readily actuated or operated to engage with the required or predetermined number of the weight members 30 and/or the weight elements 50 by actuating or rotating the actuating member 85 relative to the receptacle 10.

Accordingly, the adjustable dumbbell assembly in accordance with the present invention includes an easily and quickly adjustable structure for easily and quickly adjusting the weight of two adjustable dumbbell devices or mechanisms of the dumbbell assembly.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable dumbbell assembly comprising:

a receptacle including a first compartment and a second compartment, a first dumbbell mechanism including a first weight member engaged in said first compartment of said receptacle, a second weight member engaged in said second compartment of said receptacle, and a handle bar engaged between said first weight member and said second weight member, said handle bar including a bore formed in said handle bar, a first catch and a second catch slidably received and engaged in said bore of said handle bar and extendible out of said handle bar and respectively engageable with said first weight member and said second weight member, for detachably attaching said first weight member and said second weight member to said handle bar, a first follower and a second follower slidably received and engaged in said receptacle, and a wheel engaged with said first and said second followers for actuating said first and said second followers to move relative to said receptacle and for actuating said first and said second followers to move said first catch and said second catch to engage with said first weight member and said second weight member.

2. The adjustable dumbbell assembly as claimed in claim 1 further comprising a second dumbbell mechanism including a first weight element and a second weight element engaged in said receptacle, and a second handle bar engaged between said first and said second weight elements, said second handle bar including a bore formed in said second handle bar, a first latch and a second latch slidably received and engaged in said bore of said second handle bar and extendible out of said second handle bar and respectively engageable with said first weight element and said second weight element, for detachably attaching said first and said second weight elements to said second handle bar.

3. The adjustable dumbbell assembly as claimed in claim 2, wherein said second handle bar includes two second housings provided at end portions, said bore of said second handle bar is formed through said two second housings.

4. The adjustable dumbbell assembly as claimed in claim 3, wherein said first and said second weight elements each include two projections, and said two second housings each include two dovetail slots formed in said two second housings respectively for receiving and engaging with said two projections of said first and said second weight elements and for anchoring said first and said second weight elements to said two second housings of said second handle bar respectively.

5. The adjustable dumbbell assembly as claimed in claim 3, wherein said two second housings each include a key hole formed in said respective second housing, and said first and said second weight elements each include a key hole configured to be aligned with said key holes of said two second housings.

6. The adjustable dumbbell assembly as claimed in claim 5, wherein said first and said second latches each include an extension slidably engageable into and through said key holes of said two second housings and of said first and said second weight elements.

7. The adjustable dumbbell assembly as claimed in claim 5, wherein said first and said second weight elements each include a seat provided in a lower portion of said respective key hole of said first and said second weight elements, said two second housings each include a seat provided in a lower portion of said respective key hole of said two second housing.

8. The adjustable dumbbell assembly as claimed in claim 7, wherein said first and said second followers each include a protrusion for respectively engaging with said first and said second latches and for moving said first and said second latches to engage with said first and said second weight elements, and for detachably attaching said first and said second weight elements to said second handle bar, said first and said second latches each include a spring biased sliding member respectively engageable with said seat of said first and said second weight elements and said two second housings, each of said spring biased sliding members is engageable with said protrusion of said first and said second followers selectively.

9. The adjustable dumbbell assembly as claimed in claim 1, wherein said handle bar includes two housings provided at end portions, said bore of said handle bar is formed through said two housings.

10. The adjustable dumbbell assembly as claimed in claim 9, wherein said first and said second weight members each include two projections, and said two housings each include two dovetail slots formed in said two housings respectively for receiving and engaging with said two projections of said first and said second weight members and for anchoring said first and said second weight members to said two housings of said handle bar respectively.

11. The adjustable dumbbell assembly as claimed in claim 9, wherein said two housings each include a key hole formed in said respective housing, and said first and said second weight members each include a key hole configured to be aligned with said key holes of said two housings.

12. The adjustable dumbbell assembly as claimed in claim 11, wherein said first and said second catches each include an extension slidably engageable into and through said key holes of said two housings and of said first and said second weight members.

13. The adjustable dumbbell assembly as claimed in claim 11, wherein said first and said second weight members each include a seat provided in a lower portion of said respective key hole of said first and said second weight members, said two housings each include a seat provided in a lower portion of said respective key hole of said two housing.

14. The adjustable dumbbell assembly as claimed in claim 13, wherein said first follower and said second follower each include a protrusion for respectively engaging with said first catch and said second catch, and said first and said second catches each include a spring biased sliding member respectively engageable with said seat of said first and said second weight members and said two housings, each of said spring biased sliding members is engageable with said protrusion of said first and said second followers selectively.

15. The adjustable dumbbell assembly as claimed in claim 1, wherein said first follower and said second follower each include a protrusion for respectively engaging with said first catch and said second catch and for moving said first catch and said second catch to engage with said first weight member and said second weight member, and for detachably attaching said first weight member and said second weight member to said handle bar.

16. The adjustable dumbbell assembly as claimed in claim 15, wherein said receptacle includes two grooves formed in said receptacle for slidably receiving and engaging with said protrusions of said first follower and said second follower respectively.

17. The adjustable dumbbell assembly as claimed in claim 15, wherein said receptacle includes a plurality of notches formed in said receptacle, and said protrusions of said first and said second followers each include a tongue for engaging with said plurality of notches of said receptacle.

18. The adjustable dumbbell assembly as claimed in claim 1, wherein said first and said second followers each include a rack, and said wheel is engaged with said racks of said first and said second followers for moving said first and said second followers relative to each other.

19. The adjustable dumbbell assembly as claimed in claim 18, wherein a motor driving is coupled to said wheel for driving said wheel to move said first and said second followers relative to said receptacle.

20. The adjustable dumbbell assembly as claimed in claim 1, wherein said first and said second weight members each include two dovetail slots formed in said first and said second weight members respectively.

* * * * *